US007900814B2

(12) United States Patent
McBride

(10) Patent No.: US 7,900,814 B2
(45) Date of Patent: Mar. 8, 2011

(54) FILE FOLDER

(76) Inventor: Ruby McBride, Knoxville, TN (US)

( * ) Notice: Subject to any disclaimer, the term of this patent is extended or adjusted under 35 U.S.C. 154(b) by 688 days.

(21) Appl. No.: 11/982,280

(22) Filed: Nov. 1, 2007

(65) Prior Publication Data

US 2009/0114705 A1 May 7, 2009

(51) Int. Cl.

| | |
|---|---|
| ***B65D 27/00*** | (2006.01) |
| ***B65D 27/08*** | (2006.01) |
| ***B65D 30/22*** | (2006.01) |
| ***B65D 30/20*** | (2006.01) |

(52) U.S. Cl. ..... 229/67.3; 229/72; 383/40; 383/120

(58) Field of Classification Search ..... 229/62.3, 229/928, 72; 383/120, 40

See application file for complete search history.

(56) References Cited

U.S. PATENT DOCUMENTS

| | | | | |
|---|---|---|---|---|
| 1,956,325 | A * | 4/1934 | Hart | 229/67.3 |
| 4,549,688 | A * | 10/1985 | Ozmon et al. | 229/67.3 |
| 5,398,866 | A * | 3/1995 | Bluemle | 229/68.1 |
| 6,047,879 | A | 4/2000 | Henrikson et al. | |
| 6,098,872 | A * | 8/2000 | Ong | 229/72 |
| 6,164,821 | A * | 12/2000 | Randall | 383/34 |
| 6,273,470 | B1 | 8/2001 | Bullock | |
| 6,880,747 | B1 | 4/2005 | Pelleg | |
| 6,905,064 | B1 | 6/2005 | Ong | |
| 2003/0201311 | A1 | 10/2003 | Lindley | |
| 2006/0054669 | A1 | 3/2006 | Hsieh | |
| 2006/0108403 | A1 | 5/2006 | Ho | |

* cited by examiner

*Primary Examiner* — Jes F Pascua
(74) *Attorney, Agent, or Firm* — Michael E. McKee

(57) ABSTRACT

A file folder having front and rear panels, two side panels and a bottom panel which are joined to one another along foldable edges has an arrangement of fold lines which enable the folder to be readily moved between a fully opened condition for use and a collapsed condition for storage. The arrangement of fold lines includes a first fold line which extends across the front panel, and each side panel includes a second fold line which extends downwardly along each of the side panels from the top of the folder toward the bottom panel thereof. Each side panel further includes a third, fourth and fifth fold lines which extend from either an edge of the front panel or from a corresponding corner of the folder to a location at which the third, fourth and fifth fold lines intersect one another.

6 Claims, 4 Drawing Sheets

FILE FOLDER

BACKGROUND OF THE INVENTION

This invention relates generally to file folders and relates, more particularly, to a file folder whose features enhance its usefulness.

The class of file folders with which this invention is to be compared includes a common accordion-style folder which can be expanded from a collapsed condition for storage to an enlarged, or expanded, condition for holding documents or other relatively flat items. Such an accordian-style folder includes bottom and side portions which are joined between the front and back panels of the folder and which include an arrangement of fold lines which accommodate the movement of the front and back panels of the folder toward and away from one another as the bottom and side portions collapse and expand in a manner resembling the movement of pleated bellows.

It would be desirable to provide a file folder whose fold lines are much less complicated than the arrangement of fold lines normally associated with accordion-style folders of the prior art and which enable the folder to be quickly expanded to a condition for use or collapsed to a condition for storage.

Accordingly, it is an object of the present invention to provide a new and improved file folder which can be quickly expanded to a position for use or collapsed to a condition for storage.

Another object of the present invention is to provide such a folder embodying relatively few fold lines which enable the folder to be moved between expanded and collapsed conditions.

Still another object of the present invention is to provide such a folder which is constructed of a relatively durable material.

Yet another object of the present invention is to provide such a folder which is provided with a tab accommodating the labeling of the folder.

A further object of the present invention is to provide such a folder having a storage pocket for holding a diskette or a similarly-sized item.

A still further object of the present invention is to provide such a folder having a front panel which is provided with a transparent sheet behind which a sheet, such as one bearing an identification of file contents, can be readily inserted.

A yet still further object of the present invention is to provide such a folder which can be grasped for lifting with the fingers with reduced likelihood that the file will slip from the fingers when lifted.

One more object of the present invention is to provide such a folder which is uncomplicated in construction, yet effective in operation.

SUMMARY OF THE INVENTION

This invention resides in a file folder for use in an office environment, such as that of a law office.

The file folder includes a front panel having two opposite side edges and opposite top and bottom edges which extend between the side edges of the front panel, a rear panel having two opposite side edges and opposite top and bottom edges which extend between the side edges of the rear panel, and two side panels which are joined between the front and rear panels to provide two sides for the folder and wherein each side panel includes a forward edge to which a side edge of the front panel is joined and a rearward edge to which a side edge of the rear panel is joined. Furthermore, each side panel further includes opposite top and bottom edges which extend between the forward and rearward edges of the side panel, and the folder further includes a bottom panel which is joined between the front, rear and side panels to provide a bottom for the folder. Moreover, the bottom panel meets the front panel and the side panels at two forward corners of the folder, and the bottom panel meets the rear panel and the side panels at two rearward corners of the folder so that the front, rear, side and bottom panels collectively define an interior for the folder, and the top edges of the front, rear and side panels collectively define a top through which the interior of the folder is accessible.

In addition, the front panel defines a first fold line which extends from one side panel to the other side panel so that the front panel is divided by the first fold line into an upper portion and a lower portion, and each side panel defines a second fold line which extends downwardly from the top edge of the side panel toward the bottom panel so that the side panel is divided by the second fold line into a forward portion and a rearward portion. Each side panel further defines a third fold line which extends rearwardly along the side panel from the location at which the first fold line meets the side panel to the second fold line, and each side panel further defines a fourth fold line which extends from the location at which the second fold line meets the third fold line to a forward corner of the folder and a fifth fold line which extends from the location at which the second fold line meets the third fold line to a rearward corner of the folder. These fold lines permit the folder to be folded from an open condition into a collapsed condition by folding the forward and rearward portions of the side panels against one another along the second fold line and by folding the upper and lower portions of the front panel against one another along the first fold line while each of the second panels is folded about itself about the third, fourth and fifth fold lines.

DETAILED DESCRIPTION OF AN ILLUSTRATIVE EMBODIMENT

Figure 1:
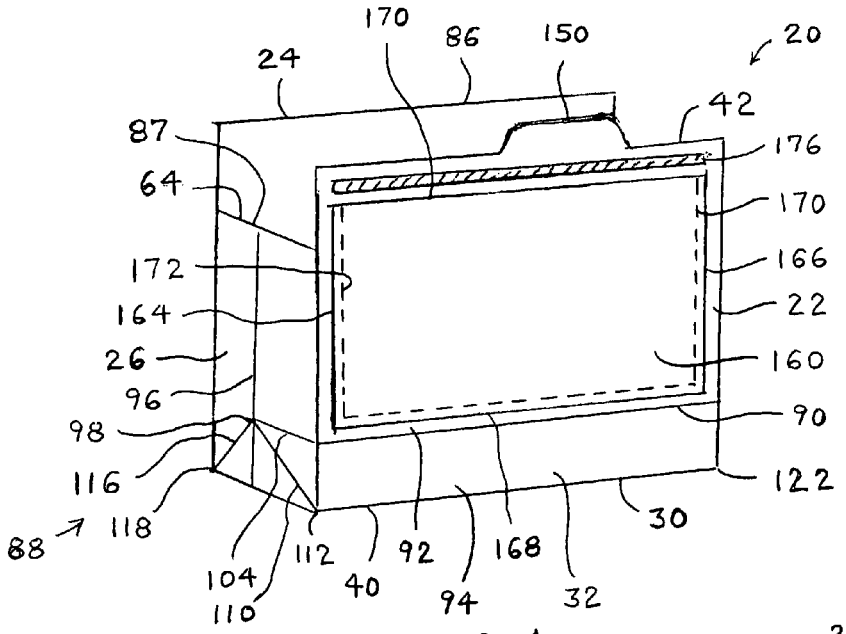
FIG. 1 is a perspective view of a folder within which features of the present invention are embodied.

Turning now to the drawings in greater detail and considering first FIG. 1, there is illustrated an embodiment, generally indicated 20, of an embodiment of a folder within which features of the present invention are embodied. The folder 20 is capable of being moved between an open condition for accepting documents and papers placed therein and a collapsed condition at which the folder 20 is in a substantially flattened condition. In addition, the folder 20 is particularly well-suited for use in a law office for holding substantially flat materials, such as documents and letters.

The folder 20 includes a front panel 22, a rear panel 24, two side panels 26, 28 and a bottom panel 30. Within the depicted folder 20, the front and rear panels 22, 24 are about the same in width as one another, although the height of the front panel 22 is slightly smaller (e.g. about one-half inch) than that of the rear panel 24. Meanwhile, the two side panels 26, 28 are about the same in size as one another, although the height of each of the panels 26, 28 is appreciably shorter than that of the front or rear panel 22 or 24. Furthermore, the bottom panel 30 spans the length of the front and rear panels 22, 24 and possesses a width which is about the same as that of each of the two side panels 26, 28.

As best shown in FIG. 1, the front panel 22 includes a front surface 32 and opposite rear surface 34, two opposite side edges 36, 38, a bottom edge 40 and a top edge 42. Similarly, the rear panel 24 includes a front surface 44, an opposite rear surface 45, two opposite side edges 46, 48, a bottom edge 50 and a top edge 52.

One side panel 26 includes an outer surface 54, an opposite inner surface 56, a forward edge 58, a rearward edge 60, a bottom edge 62 and a top edge 64. Similarly, the other side panel 28 includes an outer surface 66, an opposite inner surface 68, a forward edge 70, a rearward edge 72, a bottom edge 74 and a top edge 76. The bottom panel 30 has a forward edge 78, a rearward edge 80 and two opposite side edges 82, 84.

When the aforedescribed panels of the folder 20 are joined to one another to form the assembled FIG. 1 folder 20, the side edge 36 of the front panel 22 is joined to and extends along the forward edge 58 of one side panel 26, the side edge 38 is joined to and extends along the forward edge 70, and the bottom edge 40 of the front panel 22 is joined to and extends along the length of the forward edge 78 of the bottom panel 30. Moreover, the side edge 46 of the rear panel 24 is joined to and extends along the rearward edge 60 of one side panel 26, the side edge 48 of the rear panel 24 is joined to and extends along the rearward edge 72 of the other side panel 28, and the bottom edge 50 of the rear panel 24 is joined to and extends along the length of the rearward edge 80 of the bottom panel 30.

It will also be understood that the folder 20 is capable of being folded about the panel edges at which the various panels are joined to one another. For example, the front panel 22 can be moved relative to the bottom panel 30 as the front panel 22 is pivoted (e.g. folded) about the bottom edge 40, and the rear panel 22 can be moved relative to the bottom panel 30 as the rear panel 22 is pivoted (e.g. folded) about the bottom edge 50. As will be apparent herein and when the folder 20 is moved between its open condition and its collapsed condition, several of the panel edges, such as the side and bottom edges of the front and rear panels 22, 24, permit the adjacent panels to be pivoted (e.g. folded) relative to one another. Accordingly, the joinder of the various panels of the folder 20 to one another along the edges thereof permit such a pivoting of the adjacent panels relative to one another about the edges thereof.

Collectively, the top edge 42 of the front panel 22, the top edge 52 of the rear panel 24, the top edge 64 of one side panel 26, and the top edge 76 of the other side panel 28 define the top 86 (FIG. 1) of the folder 20 through which access is provided to the folder interior, indicated 87 in FIG. 1.

Figure 6:
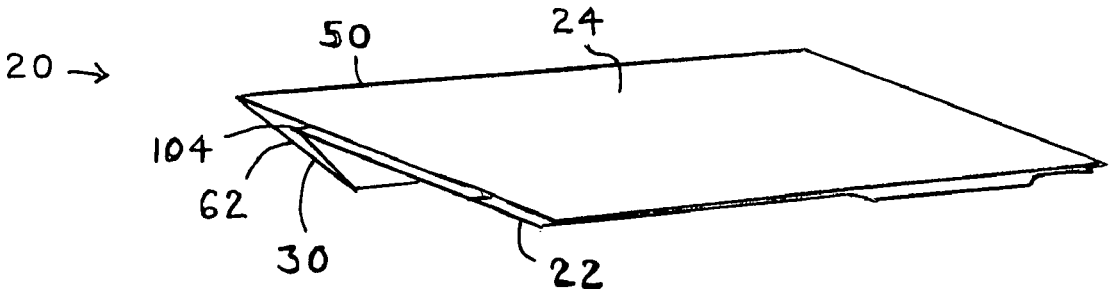

It is a feature of the folder 20 that it is capable of being readily moved from an open condition (as illustrated in FIG. 1) at which the folder 20 is in condition for accepting contents (e.g. substantially flat items, such as documents and letters) and a collapsed condition (as illustrated in FIG. 6) for storage. To this end, selected panels of the folder 20 include as arrangement, generally indicated 88 in FIG. 1, of fold lines which are formed and extend across the panels and which permit selected ones of the panels to be readily folded between an unfolded and a folded condition so that the folder 20 is moved between its open and collapsed conditions.

With reference again to FIGS. 1 and 2, the arrangement 88 of fold lines includes a first fold line 90 which extends laterally across the front panel 22 between its side edges 36, 38 and divides the front surface 32 of the front panel 22 into an upper portion 92 and a lower portion 94. As will be apparent herein, the first fold 90 line permits the front panel 22 to be folded upon itself so that the upper portion 92 thereof engages the lower portion 94 thereof. In the depicted folder 20, the first fold line 90 is disposed about one-fifth of the way up the front surface 32 of the folder 20 from the bottom edge 40, but it will be understood that in an alternative embodiment of a folder, such a first fold line can be positioned at an alternative distance from the bottom edge 40 of the front panel 22.

The remainder of the fold lines of the arrangement 88 of fold lines are defined along the side panels 26, 28. In particular, one side panel 26 includes a fold line 96 which extends downwardly through about the middle of the side panel 26 from the top edge 64 thereof to a location, indicated 98 in FIG. 2, on the side panel 26 which is about even with (e.g. located about on a horizontal plane with) the fold line 90 of the front panel 22. Similarly, the other side panel 28 includes a fold line 100 which extends downwardly through about the middle of the side panel 28 from the top edge 64 thereof to a location, indicated 102 in FIG. 2, on the side panel 28 which is about even with (e.g. located about on a horizontal plane with) the fold line 90 of the front panel 22. Each of the pair of fold lines 96 and 100 divides its corresponding side panel 26 or 28 into forward and rearward sections, and as will be apparent herein, each of the fold lines 102 and 104 permits the corresponding side panel 26 or 28 to be folded so that the outer surfaces of its forward and rearward sections engage one another.

Figure 2:
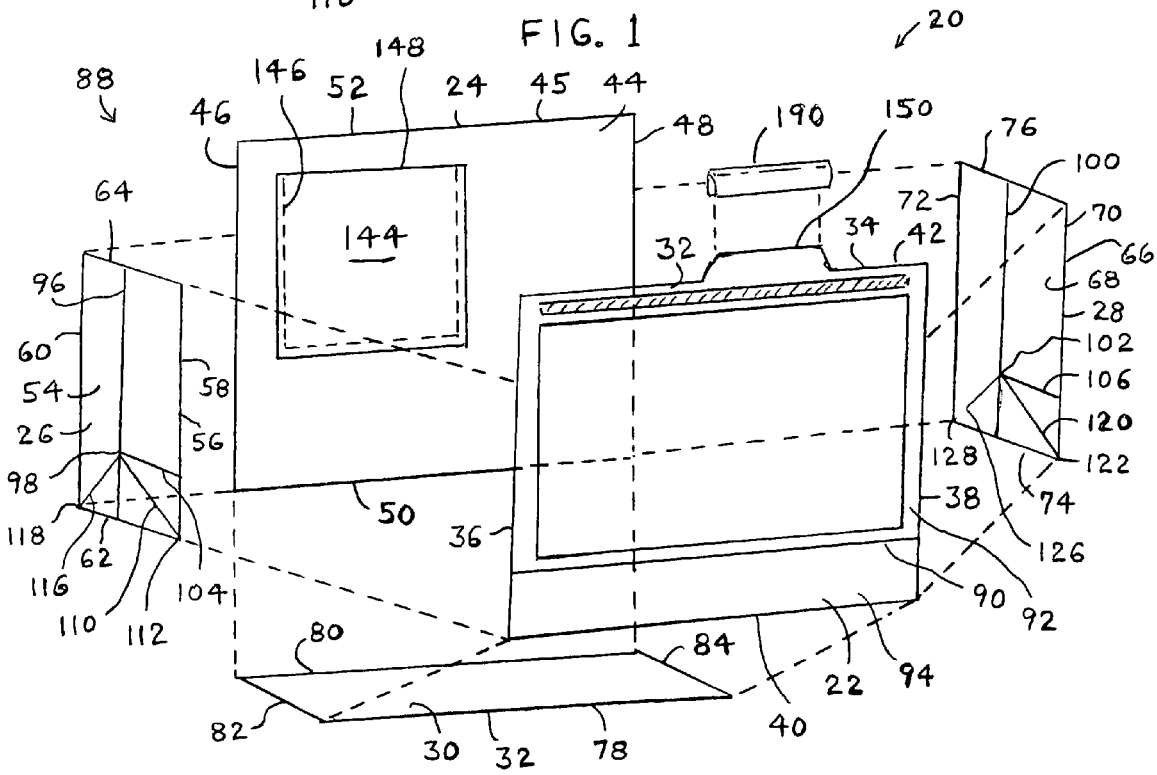
FIG. 2 is a perspective view of the FIG. 1 folder whose panels have been separated from one another along the edges thereof for display of the folder in an exploded condition.

If desired and to facilitate the folding of the side panels 26 and 28 along the fold lines 102 and 104, each of these fold lines 102 and 104 can be extended downwardly through the FIG. 2 location 98 or 102 to the bottom edge 62 or 74 of the panel 26 or 28.

In addition, there is provided along one side panel 26 another fold line 104 which extends laterally across a portion of the side panel 26 from the location at which the first fold line 90 (of the front panel 22) meets the side edge 36 to the location 98 at which the fold line 104 meets the fold line 96. Similarly, there is provided along the other side panel 28 another fold line 106 which extends laterally across a portion of the side panel 28 from the location at which the first fold line 90 (of the front panel 22) meets the side edge 38 to the location 102 at which the fold line 106 meets the fold line 100. As will be apparent herein, these fold lines 104 and 106 enable the front panel 22 to be folded upon itself during the movement of the folder 20 into a collapsed condition.

Still further, one side panel 26 includes still another fold line 110 which extends angularly across the side panel 26 from the location 98 at which the fold lines 96 and 104 meet one another to the front corner location, indicated 112 in FIG. 1, at which the front panel 22, the side panel 26 and the bottom panel 30 meet one another, and the side panel 26 includes yet another fold line 116 which extends angularly across the side panel 26 from the location 98 to the rear corner location, indicated 118 in FIG. 1 at which the rear panel 24, the side panel 26 and the bottom panel 30 meet one another. Similarly, the other side panel 28 includes another fold line 120 which extends angularly across the side panel 28 from the location 102 at which the fold lines 100 and 106 meet one another to the front corner location, indicated 122 in FIG. 1 at which the front panel 22, the side panel 38 and the bottom panel 30 meet one another, and the side panel 26 includes yet another fold line 126 which extends angularly across the side panel 26 from the location 102 to the rear corner location, indicated 128 in FIG. 2, at which the rear panel 24, the side panel 38 and the bottom panel 30 meet one another. As will be apparent herein, these two sets of fold lines 110, 116 and 120, 126 (each of which provide a V-shape whose apex coincides with the location 98 or 102 and whose V shape opens downwardly) facilitates the folding up of the side panels 26 and 28 when the folder 20 is moved from its open condition into a collapsed condition.

With reference to FIGS. 3 through 6, there are illustrated various positions of the folder 20 when it is folded from its fully open condition of FIG. 1 to a fully collapsed condition as illustrated in FIG. 6 suitable, for example, for storage of the folder 20. As will be apparent herein, various ones of the panels of the folder 20 are folded about the fold lines of the arrangement 88 and edges of various ones of the panels to enable the folder 20 to be folded to its collapsed condition.

Figure 3:
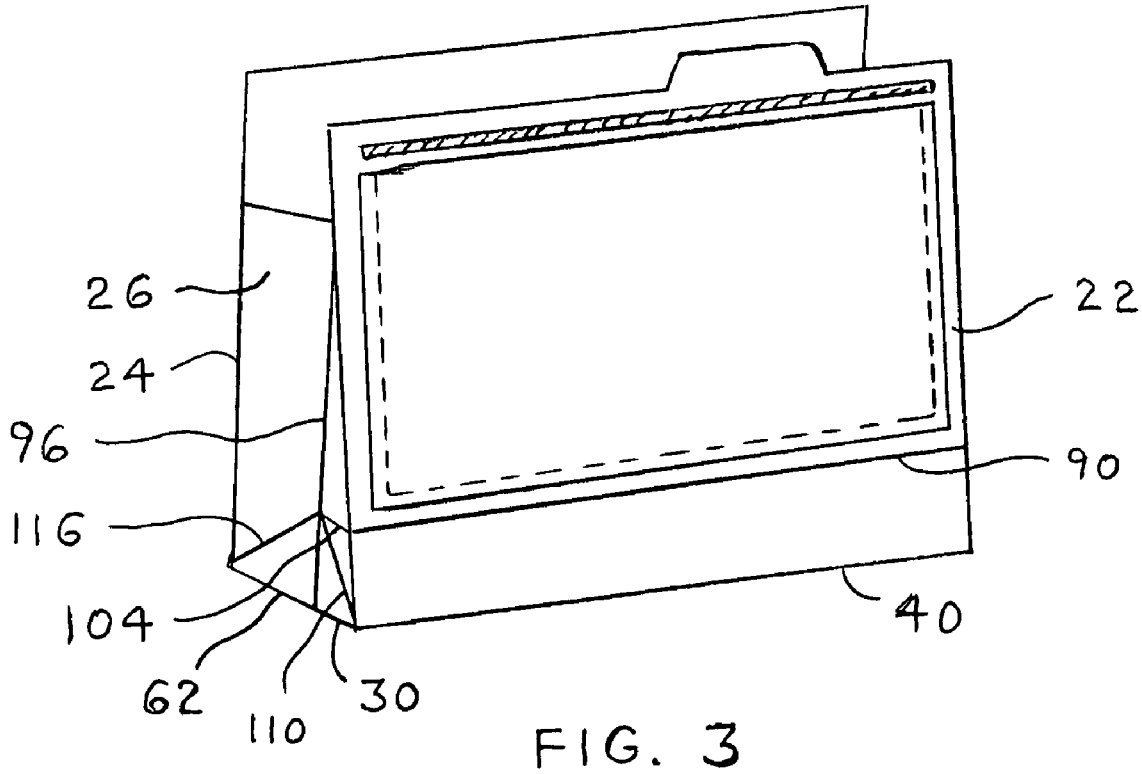
FIGS. 3-6 are perspective views depicting the FIG. 1 folder being folded from an open condition into a collapsed condition.

In particular and to move an open folder 20 to its FIG. 6 collapsed condition, the side panels 26 and 28 are folded about the fold lines 96 and 100 so that the forward and rearward portions of the side panels 26 and 28 begin to move toward one another as illustrated in FIG. 3. As the forward and rearward portions of the side panels 26, 28 are folded toward one another about the fold lines 99, 100, the side panels 26, 28 are also pivoted (e.g. folded) about the two side edges 36, 38 of the front panel 22, about the two side edges 46, 48 of the rear panel 24, and about the side edges 82, 84 of the bottom panel 30. The side panels 26 and 28 continue to be folded against one another toward and into the condition illustrated in FIG. 4 while the side panels 26 and 28 are simultaneously folded about the sets of fold lines 110, 116 and 120, 126 (and panel edges 36, 38, 46, 48, 82 and 84) to facilitate the engagement of (the outer surfaces of) the forward and rearward portions of the side panels 26 and 28 against one another. In this connection, each set of fold lines 110, 116 and 112, 126 permit the outer surfaces of the adjacent portions of the side panels 26 and 28 to be folded toward one another.

Figure 4:
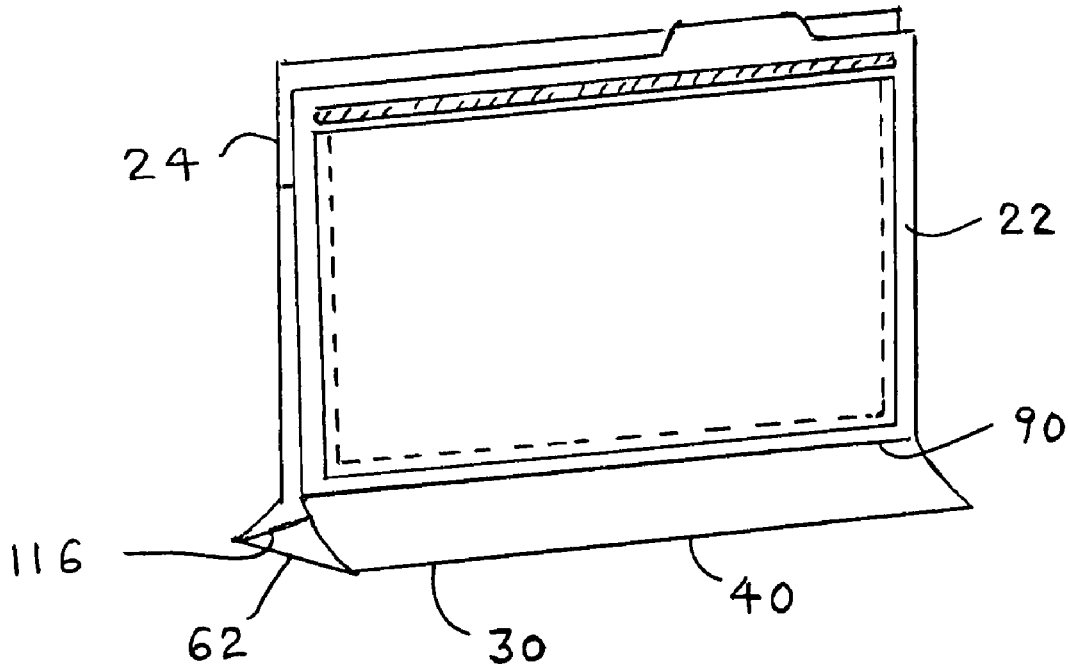
Figure 5:
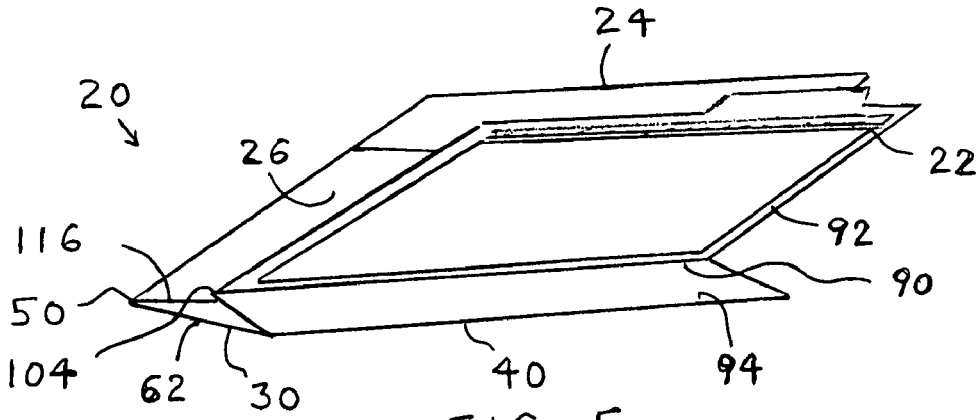

Having placed the folder 20 in the condition illustrated in FIG. 4, the folder 20 is then folded about the first fold line 90 which extends across the front panel 22 and about the fold lines 104 and 106 which extend across a portion of the side panels 26 and 28. By folding the folder 20 in this manner, the front panel 22 is moved in sequence (from the FIG. 4 illustrated condition) into the FIG. 5 condition and then into the FIG. 6 collapsed condition as the front and rear panels 22, 24 are pivoted (e.g. folded) relative to the bottom panel 30 about the panel edges 40 and 50. It follows that during the movement of the folder 20 from its open condition to the collapsed, substantially flattened FIG. 6 condition, the fold lines 104 and 106 of the side panels 26 and 28 permit the side panels 26 and 28 to be folded upon themselves in a manner which better facilitates the folding of the front surface 32 of the front panel 32 onto itself about the first fold line 90. In other words and as best shown in the view of FIG. 6, the front panel 22 is folded upon itself about the first fold line 90 in conjunction with the folding of the side panels 26 and 28 about the fold lines 104 and 106 as each of the front panel 22, side panels 26, 28 and the bottom panel 30 is pivoted (e.g. folded) relative to its adjacent panel about a corresponding panel edge 40, 50, 36, 38, 46, 48 or 82.

Figure 7:
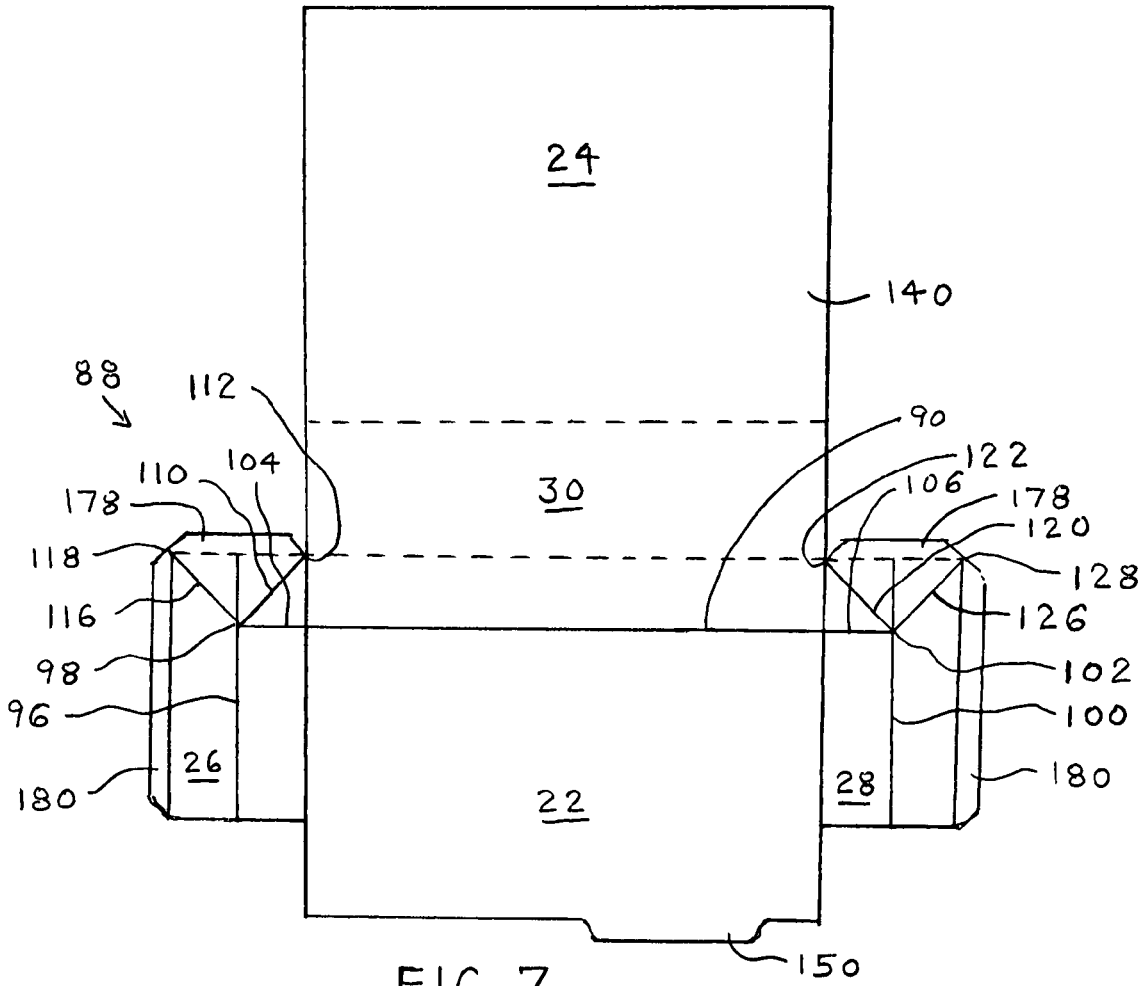
FIG. 7 is a plan view of a blank of sheet material which has been appropriately cut and provided with fold lines which enable the blank to be folded and attached to itself to form the FIG. 1 folder.

With reference to FIG. 7, there is illustrated a blank, indicated 140 in FIG. 7, of material whose various sections can be folded together, and attached, where appropriate, to form the front and rear panels 22, 24, the bottom panel 30 and the side panels 26, 28 of the folder 20. Within the FIG. 7 blank 140, the various portions thereof which provide the front and rear panels 22, 24, the bottom panel 30 and the side panels 24, 26 have been identified with the same reference numerals. Each of the various portions of the blank which provide these panels are pre-scored or pre-perforated along the edges at which adjacent panels are joined and the fold lines of the arrangement 88, where appropriate, so that when folded and attached together to form the folder 20, the folder 20 is provided with the aforedescribed fold lines (i.e. of the arrangement 88) and the foldable panel edges enabling the folder 20 to be moved between a fully opened condition for use and a collapsed condition for storage. In the connection with the foregoing, the blank 140 is provided with tabs 178, 180 which are joined (along foldable edges) to the portions of the blank 140 which form the side panels 26, 28 so that when folding the blank lines 140 together to form the folder 20, the tabs 178, 180 can be folded around and glued, or otherwise bonded, to the rear surface 34 of the rear panel 24 and to the bottom surface of the bottom panel 32.

With reference still to FIG. 1, another feature of the folder 20 is that it is constructed of a relatively durable material. More specifically, the material out of which the folder 20 is constructed is adapted to resist damage, such as a weakening of the folder material due to exposure to moisture or dry-rot, which commonly plagues folders which are constructed out of a paper material. One material which is well-suited for use in the construction of the folder 20 is polypropylene.

Figure 8:
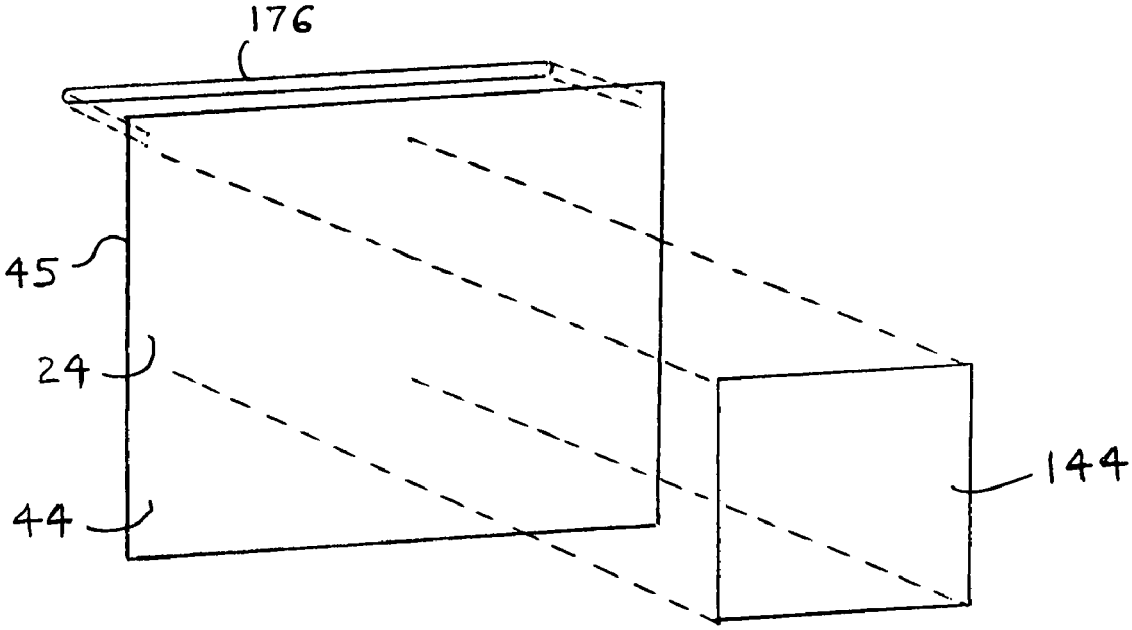
FIG. 8 is a perspective view of the rear panel of the FIG. 1 folder, shown exploded.

With reference to FIGS. 1 and 8, the folder 20 further includes means, indicated 142, providing an auxiliary pocket within which items, such as a diskette or similarly-shaped items, can be placed. Within the depicted folder 20, the auxiliary pocket 142 is formed with a four-edged, flat piece 144 of material (e.g. polypropylene) having three of its edges (i.e. its side and bottom edges) which have been glued, or otherwise bonded, to the front surface 44 of the rear panel 24 of the folder 20 along a path 146 (FIG. 8) so that the piece 144 provides, with the front surface 44 of the rear panel 24, the auxiliary pocket 142 having an open, upwardly-directed top 148. It follows that the top 148 provides access to the interior of the pocket 142 so that a relatively flat item, such as a diskette or a similarly-sized item, to be directed into the interior of the pocket 142 for storage. Furthermore and because the pocket 142 of the depicted folder 20 is situated within the interior of the folder 20, an item placed into the pocket is well-protected by the front and rear panels 22, 24 of the folder 20.

Furthermore and by arranging and attaching the piece 144 along the rear panel 24 of the folder 20 so that the top 148 of the auxiliary pocket 142 is disposed adjacent the top 86 of the folder 20, the top 148 of the pocket 142 is readily accessible by a user for inserting an item, such as a diskette, into the pocket 142 or for retrieving the item from the pocket 142. Accordingly, the positioning of the auxiliary pocket 142 within the interior of the folder 22 is further advantageous in this respect.

It is also a feature of the folder 20 that at least one of the upper edges of the front or rear panels is provided with a tab portion 150 which extends upwardly above the remainder of the upper edge 42 or 52 of the front or rear panel 22 or 24. This tab portion 150 provides a flat surface 152 upon which indicia may be printed for identifying the contents of the folder 20. Furthermore and because the tab portion 152 extends above the remainder of the folder 20, by filing the folder 20 alongside folders possessing about the same size as that of the folder 20, the tab portion 152, and any content-identification indicia borne thereby, is readily viewable by a user.

If desired, a transparent cover, indicated 190 in FIG. 2 and having a U-shaped cross section, can be slipped downwardly upon the tab portion 150 for securement thereto. Because each of the opposite ends of the cover 190 is open, an appropriately-sized label (not shown) can be inserted into the cover 190 through an end thereof and into a position at which the label can be seen through the front portion of the cover 190. Thus, the cover 190 enables the folder 20 to be labeled at the tab portion 150 without requiring that the tab portion 150 be written upon or otherwise marked.

Figure 9:
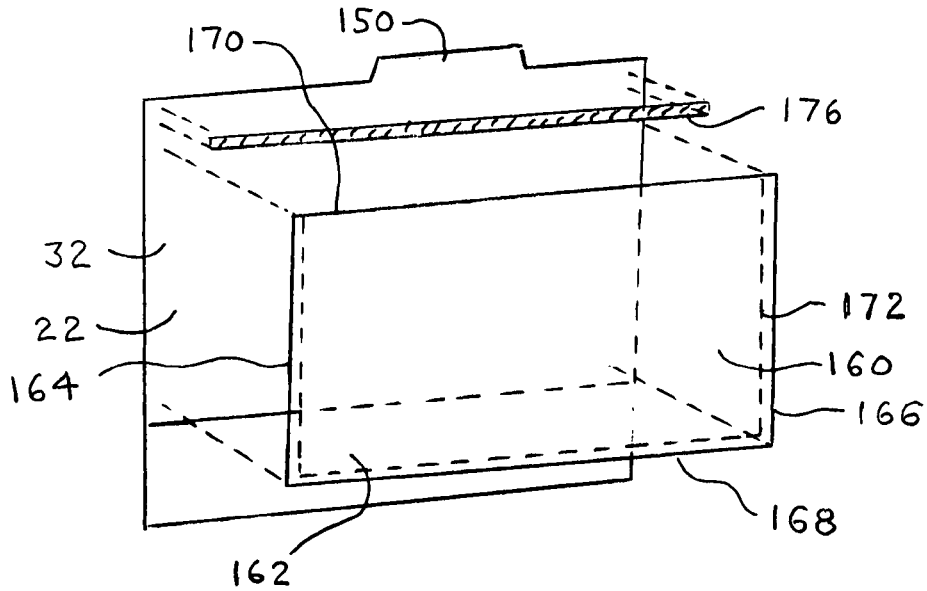
FIG. 9 is a perspective view of the front panel of the FIG. 1 folder, shown exploded.

With reference to FIGS. 1 and 9, it is also a feature of the folder 20 that it includes a transparent panel 160 associated with the front panel 22 which accommodates the positioning of a sheet (e.g. a paper sheet) between the front surface 32 of the front panel 22 and the transparent panel 160. To this end, the transparent panel 160 can be provided by a clear piece of plastic sheet 162 having opposite side edges 164, 166 and opposite bottom and top edges 168, 170, respectively, and the side and bottom edges 164, 166, 168 are glued, or otherwise bonded, to the front surface 32 along a path, indicated 172 in FIG. 9, so that a sheet (e.g. a paper sheet, not shown) can be inserted edgewise through the gap provided between the top edge 170 of the plastic sheet 162 and the front surface 32 of the front panel 22 so that the inserted sheet (and any indicia borne thereon) is viewable through the transparent panel 160.

In use, it is envisioned that a sheet to be inserted between the transparent panel 160 and the front surface 32 of the front panel 22 will be pre-printed with indicia which reflects information relating to the contents of the folder. If, for example, the folder 20 contains information relating to a legal action, then the information which is pre-printed upon the sheet which is subsequently inserted between the transparent panel 160 and the front surface 32 of the front panel 160 may, for example, chronicle various deadlines which must be met in the legal action. Of course, by positioning such information in a position against the front panel 22 so that the information is readily viewable through the transparent panel 160, the contents contained within the folder 20 need not be removed for purposes of seeking out this information.

Furthermore and if the information borne by an inserted sheet which is already positioned between the transparent panel 160 and the front surface 32 of the front panel 22, the inserted sheet can be readily removed (through the gap provided between the top edge 170 of the transparent panel 160 and the front surface 32 of the front panel 22 so that the information borne by the inserted sheet can be updated or revised and subsequently be re-positioned between the transparent panel 160 and the front panel 22.

Within the depicted folder 20, the transparent panel 160 is large enough to accept a sheet placed behind the panel 160 which measures eight and one-half by eleven inches in width and length, and a transparent panel 160 which possesses such a size is preferred if the interior of the folder 20 is sized to easily accept papers which possess such dimensions. If, of course, the folder 20 is sized to accept papers having alternative dimensions, such as that of legal-sized paper (i.e. eight and one-half by thirteen inches in width and length), the transparent panel 160 can be sized to accept a sheet of paper having alternative dimensions.

With reference still to FIGS. 1 and 9, it is also a feature of the folder 20 it includes an anti-slip substance, generally indicated 176 in FIGS. 1 and 9, which is disposed along sections of the front and rear panels 22, 24 which would normally be grasped with the fingers of a user who desired to lift the folder 20 from a file cabinet. Such sections (i.e. those at which the anti-slip substance 176 is attached) are located upon the front surface 32 of the front panel 22 and adjacent the top edge 42 thereof and upon the rear surface 45 of the rear panel 24 adjacent the top edge 52 thereof.

The anti-slip substance 176 can take any of a number of forms, such as a substance which is coated upon the aforedescribed sections of the front and rear panels 22, 24 in an uncured condition and which subsequently cures to a hardened condition having a rough surface, or may be an adhesive-backed anti-slip substance which is adhesively applied to the aforedescribed sections of the front and rear panels 22, 24.

It follows that the anti-slip substance 176 borne by the front and rear panels 22, 24 reduce any likelihood that the folder 20 will slip from the fingers when grasped by the user for purposes of lifting the folder 20, and the anti-slip substance 176 is advantageous in this respect.

It will be understood that numerous modifications and substitutions can be had to the aforedescribed embodiment 20 without departing from the spirit of the invention. Accordingly, the aforedescribed embodiment 20 is intended for the purpose of illustration and not as limitation.

The invention claimed is:

1. A file folder comprising:

a front panel having two opposite side edges and opposite top and bottom edges which extend between the side edges of the front panel;

a rear panel having two opposite side edges and opposite top and bottom edges which extend between the side edges of the rear panel;

two side panels which are joined between the front and rear panels to provide two sides for the folder and wherein each side panel includes a forward edge to which a side edge of the front panel is joined and a rearward edge to which a side edge of the rear panel is joined, and each side panel further includes opposite top and bottom edges which extend between the forward and rearward edges of the side panel; and a bottom panel which is joined between the front, rear and side panels to provide a bottom for the folder and wherein the bottom panel meets the front panel and the side panels at two forward corners of the folder and wherein the bottom panel meets the rear panel and the side panels at two rearward corners of the folder and so that the front, rear, side and bottom panels collectively define an interior for the folder and wherein the front panel, the rear panel and the bottom panel are formed out of a single blank of material so that the front panel is contiguous with the bottom panel along the bottom edge of the front panel and so that the rear panel is contiguous with the bottom panel along the bottom edge of the rear panel, and wherein the top edges of the front, rear and side panels collectively define a top through which the interior of the folder is accessible, and each of the front panel, rear panel, side panels and bottom panel can be pivoted relative to the adjacent panel about the corresponding edge to which the adjacent panel is joined;

the front panel defining a first fold line which extends from one side panel to the other side panel so that the front panel is divided by the first fold line into an upper portion and a lower portion;

each side panel defining a second fold line which extends downwardly from the top edge of the side panel toward the bottom panel so that the side panel is divided by the second fold line into a forward portion and a rearward portion, each side panel further defining a third fold line which extends rearwardly along the side panel from the location at which the first fold line meets the side panel to the second fold line, and each side panel further defining a fourth fold line which extends from the location at which the second fold line meets the third fold line to a forward corner of the folder and a fifth fold line which extends from the location at which the second fold line meets the third fold line to a rearward corner of the folder so that the folder can be folded from an open condition into a collapsed condition by folding the forward and rearward portions of the side panels against one another along the second fold line and by folding the upper and lower portions of the front panel against one another along the first fold line while each of the second panels is folded upon itself about its third, fourth and fifth fold lines and while each of the front panel, rear panel, side panels and bottom panel is pivoted relative to the adjacent panel about a corresponding edge to which it is joined;

a four-edged auxiliary panel which is attached to one of the front or rear panels along three edges of the auxiliary panel and within the interior of the folder so that the auxiliary panel and the one of the front and rear panels collectively defines an auxiliary compartment disposed within the interior of the folder for accepting a diskette-sized item placed therein for storage, and wherein the front panel has a front surface and the folder further comprises a transparent sheet which is attached to the front surface of the front panel so that by positioning an indicia-bearing sheet between the front surface of the front panel and the transparent sheet, the indicia-bearing sheet is viewable through the transparent sheet, and wherein the rear panel has a rear surface and the folder further comprises an amount of anti-slip substance which is attached to each of the front surface of the front panel and the rear surface of the rear panel adjacent the top of the folder so that as the folder is grasped with the fingers of a user about the front and rear surfaces for purposes of lifting the folder, the fingers engage the anti-slip substance to thereby reduce any likelihood that the folder will slip from between the fingers when lifted thereby.

2. The folder as defined in claim 1 wherein at least one of the front and rear panels includes a tab portion adjacent the top of the folder accommodating the labeling of the folder.

3. The folder as defined in claim 1 wherein each of the front, rear, side and bottom panels is constructed of polypropylene.

4. A file folder comprising:

a front panel having two opposite side edges and opposite top and bottom edges;

a rear panel having two opposite side edges and opposite top and bottom edges;

two side panels which are joined between the side edges of the front and side panels to provide two sides for the folder and having bottom edges; and a bottom panel which is joined between the bottom edges of the front panel, rear panel and side panels to provide a bottom for the folder and so that the front, rear and side panels collectively define a top through which access is provided to the interior of the folder and wherein each of the front panel, rear panel, side panels and bottom panel can be pivoted relative to the adjacent panel about the corresponding edge to which the adjacent panel is joined and wherein the front panel, the rear panel and the bottom panel are formed out of a single blank of material so that the front panel is contiguous with the bottom panel along the bottom edge of the front panel and so that the rear panel is contiguous with the bottom panel along the bottom edge of the rear panel;

the front panel having a first fold line which extends laterally thereacross and which divides the front panel into an upper portion and a lower portion, and each of the side panels having a second fold line which extends downwardly from the top of the folder and divides each side panel into a forward portion and a rearward portion, having a third fold line which extends laterally therealong from a location at which the first fold line meets the side edge of the front panel to the second fold line, having a fourth fold line which extends angularly therealong from the location at which the third fold line meets the second fold line to a corresponding front corner of the folder, and having a fifth fold line which extends angularly therealong from the location at which the third fold line meets the second fold line to a corresponding rear corner of the folder so that the folder can be folded from an open condition into a collapsed condition by folding the side panels along the second fold line so that the forward and rearward portions of each side panel engage one another and so that the side panels are folded about the fourth and fifth fold lines while each of the front panel, rear panel, side panels and bottom panel is pivoted relative to the adjacent panel about a corresponding panel to which it is joined and then by folding the front panel about the first fold line as each side panel is further folded about the third fold line;

a four-edged auxiliary panel which is attached to one of the front or rear panels along three edges of the auxiliary panel and within the interior of the folder so that the auxiliary panel and the one of the front and rear panels collectively defines an auxiliary compartment for accepting a diskette-sized item placed therein for storage within the interior of the folder, and wherein the front panel has a front surface and the folder further comprises a transparent panel which is attached to the front surface of the front panel so that by inserting a sheet between the front surface of the front panel and the transparent panel, the inserted sheet is viewable through the transparent sheet; and wherein the rear panel has a rear surface and the folder further comprises an amount of anti-slip substance which is attached to each of the front surface of the front panel and the rear surface of the rear panel adjacent the top of the folder so that as the folder is grasped with the fingers of a user about the front and rear surfaces for purposes of lifting the folder, the fingers engage the anti-slip substance to thereby reduce any likelihood that the folder will slip from between the fingers when lifted thereby.

5. The folder as defined in claim 4 wherein at least one of the front and rear panels includes a tab portion adjacent the top of the folder accommodating the labeling of the folder.

6. The folder as defined in claim 4 wherein each of the front, rear, side and bottom panels is constructed of polypropylene.

* * * * *